US009142928B2

(12) United States Patent
Christiano et al.

(10) Patent No.: US 9,142,928 B2
(45) Date of Patent: Sep. 22, 2015

(54) BULB SOCKET

(71) Applicant: TYCO ELECTRONICS BRASIL LTDA., Sao Paulo (BR)

(72) Inventors: Fabio Fortunato Christiano, Itapira-SP (BR); Jose Roberto Goldschmidt, Campinas-SP (BR); Willian Alexandre de Oliveira, Braganca Pla-SP (BR)

(73) Assignee: TYCO ELECTRONICS BRASIL LTDA., Sao Paulo (BR)

( * ) Notice: Subject to any disclaimer, the term of this patent is extended or adjusted under 35 U.S.C. 154(b) by 0 days.

(21) Appl. No.: 13/975,439

(22) Filed: Aug. 26, 2013

(65) Prior Publication Data

US 2015/0056862 A1 Feb. 26, 2015

(51) Int. Cl.
*H01R 13/66* (2006.01)
*H01R 33/09* (2006.01)

(52) U.S. Cl.
CPC ..... *H01R 33/09* (2013.01)

(58) Field of Classification Search
USPC ..... 439/620.02, 611, 356, 699.2; 313/318.01; 362/391
IPC ..... H01R 33/09; F21V 19/0005
See application file for complete search history.

(56) References Cited

U.S. PATENT DOCUMENTS

| | | | | | |
|---|---|---|---|---|---|
| 5,035,643 | A * | 7/1991 | Forish et al. | 439/358 |
| 5,041,955 | A * | 8/1991 | Devir et al. | 362/306 |
| 5,229,683 | A * | 7/1993 | Eckhardt et al. | 313/318.07 |
| 5,239,226 | A * | 8/1993 | Seredich et al. | 313/318.01 |
| 5,456,620 | A * | 10/1995 | Kaminski | 439/654 |
| 5,951,318 | A | 9/1999 | Harada | |
| 6,083,050 | A * | 7/2000 | Hsu | 439/619 |
| 2002/0061685 | A1 * | 5/2002 | Aiso | 439/699.2 |
| 2004/0190289 | A1 * | 9/2004 | Liu | 362/226 |
| 2013/0102204 | A1 | 4/2013 | Midy | |

FOREIGN PATENT DOCUMENTS

EP 1633024 A1 9/2005

* cited by examiner

*Primary Examiner* — Vanessa Girardi

(57) ABSTRACT

A bulb socket for receiving a bulb therein. The bulb socket includes a first portion and a second portion. The first portion has a bulb receiving opening. The second portion extends from the first portion. The second portion has first outside surfaces which are tapered inward, such that the perimeter of the second portion proximate the first portion is less than the perimeter of the second portion spaced from the first portion. The second portion does not obstruct the performance of the bulb, allowing approximately all of the light capacity of the bulb to be utilized.

19 Claims, 7 Drawing Sheets

BULB SOCKET

FIELD OF THE INVENTION

The present invention relates to a bulb socket and, more particularly, to a socket for a wedge base bulb (no-cap bulb) for use in a lighting device which is employed in an automobile or the like. In particular, the socket is configured to minimize shadow projections, thereby eliminating undesirable dark spots.

BACKGROUND OF THE INVENTION

Many variations of sockets for receiving bulbs, such as W5W type bulbs, are known and used in various applications, including automotive applications. In use, the lamp or bulb is generally inserted into the socket by pushing it such that the base and the electrical contacts are engaged onto the contacts of the socket. Examples of such sockets are shown in EP patent application 1633024, U.S. Patent Application 2013/0102204, and U.S. Pat. No. 5,951,318.

As the sockets all have an opening for receiving the bulb and contacts for making the electrical connection thereto, the sockets are generally dimensioned to have a housing which has a circumference which is equal to or exceed the circumference of the bulb. As a result, the sockets create a shadow to be projected behind the bulb, thereby blocking some of the light generated by the bulb, causing unwanted and undesirable dark spots.

It would, therefore, be beneficial to provide a socket with a reduced profile in which the projected shadow is minimized, thereby allowing all or essentially all of the light generated by the bulb to be reflected or dispersed.

SUMMARY OF THE INVENTION

The configuration of the bulb socket does not obstruct the performance of the bulb, allowing all or approximately all of the light capacity of the bulb to be utilized. The light from the bulbs is able to radiate in all directions without obstruction, such that shadow projections are minimized or eliminated, thereby minimizing or eliminating undesirable dark spots.

An embodiment is directed to a bulb socket for receiving a bulb therein. The bulb socket includes a first portion and a second portion. The first portion has a bulb receiving opening. The second portion extends from the first portion. The second portion has first outside surfaces which are tapered inward, such that the perimeter of the second portion proximate the first portion is less than the perimeter of the second portion spaced from the first portion. The second portion does not obstruct the performance of the bulb, allowing approximately all of the light capacity of the bulb to be utilized.

An embodiment is directed to a bulb socket for receiving a bulb therein. The bulb socket includes a first portion and a second portion. The first portion has a bulb receiving opening and has a substantially rectangular configuration. A perimeter of the first portion proximate the second portion is substantially the same as a perimeter of the first portion proximate an end of the bulb socket through which the bulb receiving opening extends. The second portion extends from the first portion and has first outside surfaces which are tapered inward. The perimeter of the second portion proximate the first portion is less than the perimeter of the second portion spaced from the first portion. The second portion has second outside surfaces which extend between the first outside surfaces. The second outside surfaces have a relatively flat configuration. The second portion does not obstruct the performance of the bulb, allowing approximately all of the light capacity of the bulb to be utilized.

An embodiment is directed to a bulb socket for receiving a bulb therein. The bulb socket includes a first portion and a second portion. The first portion has a bulb receiving opening and has a substantially rectangular configuration. A perimeter of the first portion proximate the second portion is substantially the same as a perimeter of the first portion proximate an end of the bulb socket through which the bulb receiving opening extends. The second portion extends from the first portion and has first outside surfaces which are tapered inward. The perimeter of the second portion proximate the first portion is less than the perimeter of the second portion spaced from the first portion. The second portion has second outside surfaces which extend between the first outside surfaces. The second outside surfaces have a relatively flat configuration. Terminals extend in the bulb receiving opening. Each terminal has a first resilient arm and a second resilient arm. The first resilient arm has a support portion which has a flat portion which cooperates with a base of the bulb. The second resilient arm has a contact and securing portion which has an angular portion which cooperates with a lead of the bulb. The second portion does not obstruct the performance of the bulb, allowing approximately all of the light capacity of the bulb to be utilized.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
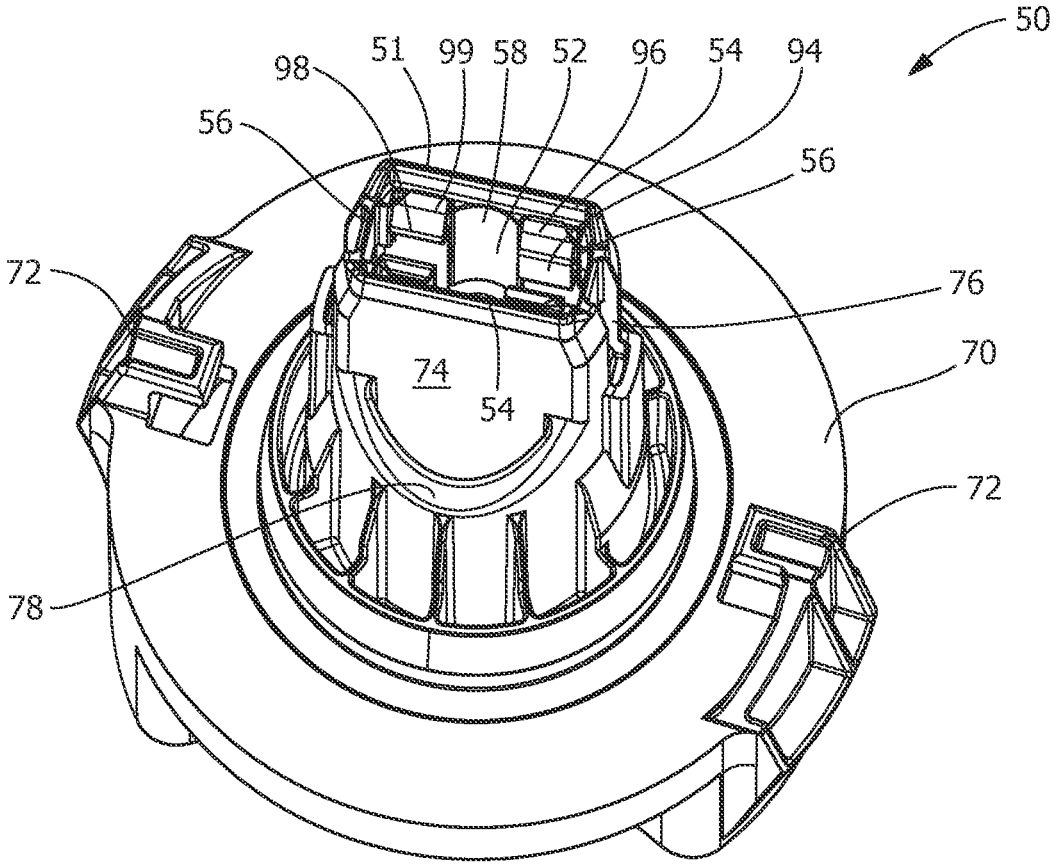
FIG. 1 is a top perspective view of an illustrative embodiment of a bulb socket according to the present invention.
Figure 2:
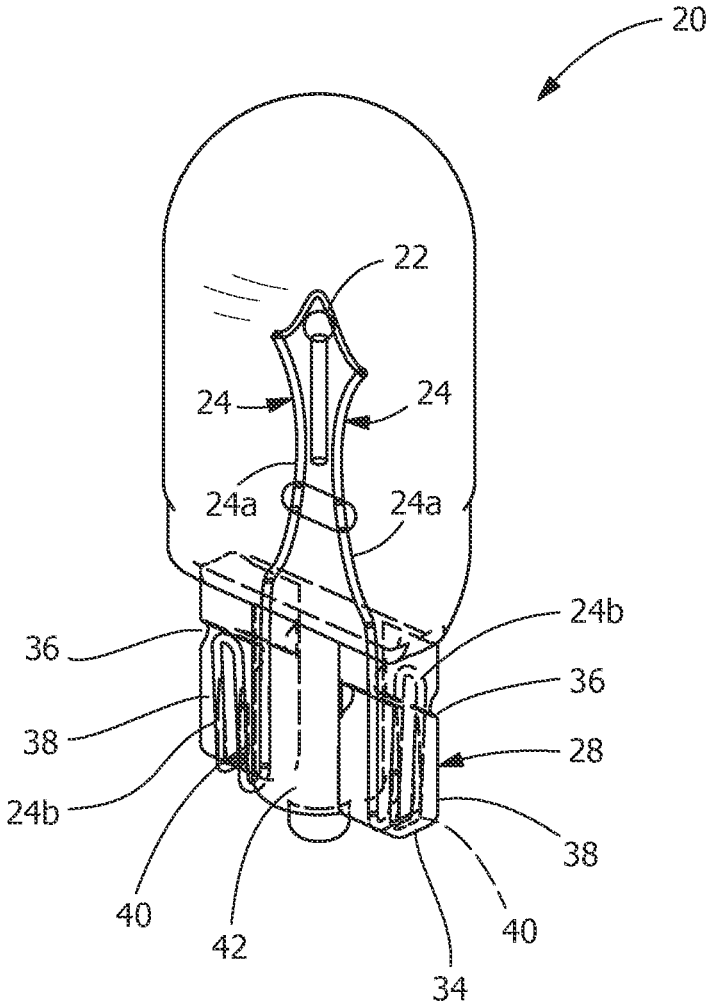
FIG. 2 is a perspective view of an illustrative bulb which can be used with the bulb socket of FIG. 1.
Figure 3:
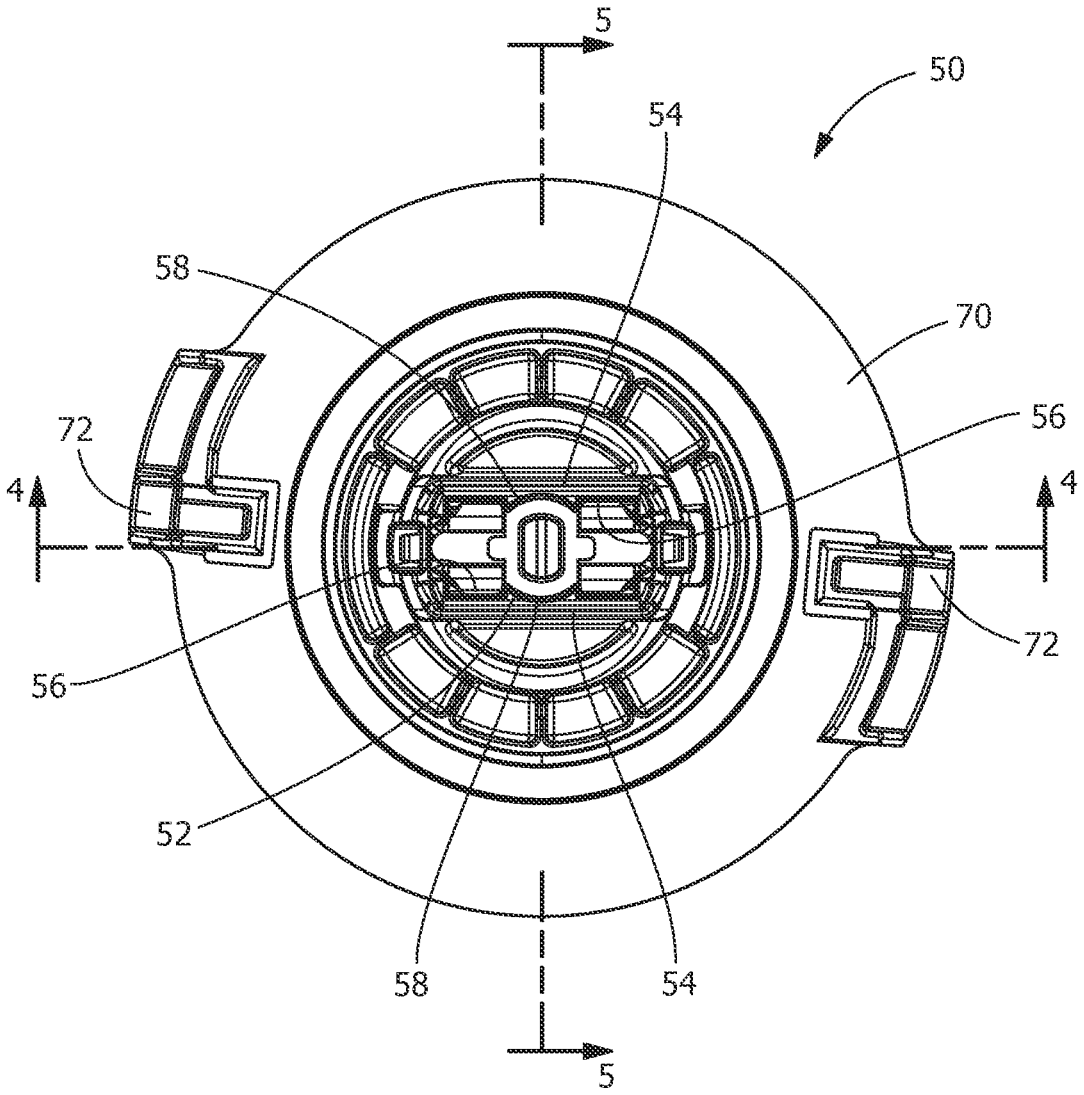
FIG. 3 is a top view of the bulb socket of FIG. 1.

The present invention will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that spatially relative terms, such as "top", "upper", "lower" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "over" other elements or features would then be oriented "under" the other elements or features. Thus, the exemplary term "over" can encompass both an orientation of over and under. The device may be otherwise oriented (rotated 90 degrees or at other orientations) and the spatially relative descriptors used herein interpreted accordingly.

The present invention is directed to a bulb socket which is configured to minimize shadow projections, thereby eliminating undesirable dark spots. In the embodiment shown, the socket accepts a wedge base bulb (no-cap bulb) for use in a lighting device which is employed in an automobile or the like. However, other bulbs and other applications, such as, but not limited to low voltage lighting used in landscaping, may be used without departing from the scope of the invention.

As shown in FIG. 1, a wedge base bulb 20 (which is hereinafter referred to as a bulb) has a filament 22 with the two ends thereof supported by lead supports 24. A portion 24*a* of each lead 24 is disposed within a glass spherical body of the bulb 20, while a portion 24*b* of each lead 24 is disposed outside of the body of the bulb 20. The bulb 20 includes a pinch-sealed flat bulb base end portion (not shown) through which the lead supports 24 are guided. A base 28, formed of synthetic resin or other suitable material, is attached to or formed over the pinch-sealed flat bulb base end portion of the bulb 20. In the embodiment shown, the base 28 has an essentially rectangular shape.

The bulb base 28 includes recessed grooves 36 are provided on opposed surfaces 38 of the base 28. Lead receiving channels 40 are also provided on opposed surfaces 38. The channels 40 extend from an end 34 of the base 28 to the grooves 36. The channels 40 are dimensioned to receive the portion 24*b* of the leads 24 therein, thereby protecting the portions 24*b* from damage while maintaining the portions 24*b* in proper position relative to the base 28. The channels 40 and portions 24*b* of leads 24 are positioned on alternating sides of the base 28.

A positioning member 42 is provided proximate the longitudinal center of the base 28. In the embodiment shown, member 42 has a cylindrical configuration, but other configurations and locations may be used without departing from the invention. A contact (not shown) may be provided at an end of member 42. If provided, the contact is electrically connected to a dual filament (not shown) to allow the bulb 20 to be used in higher wattage applications.

Referring to FIGS. 1 and 3-5, a bulb socket 50 is shown. The socket 50 may be formed of synthetic resin or any other material having the nonconductive and strength characteristics required. A bulb insertion cavity or opening 52 is provided at one end 51 of the socket 50. The bulb insertion cavity or opening 52 is formed in a rectangular shape which corresponds to the base 28 of the bulb 20 to allow the bulb 20 to be inserted into the opening 52.

The opening 52 has oppositely facing internal long walls 54 and oppositely facing internal short walls 56. The longitudinal axis of the short walls 56 extend in a direction which is essentially perpendicular to the longitudinal axis of the long walls 54. The short walls 56 may be essentially straight or have a slight arcuate configuration. Each long wall 54 has a positioning member 58 which extends between two terminal receiving areas 60. In the embodiment shown, the positioning member 58 has an arcuate configuration. The positioning member 58 cooperates with the positioning member 42 of the bulb 20 to properly position the bulb 20 in the opening 52.

Extending from a bottom wall 62 (FIG. 4) of the opening 52 are terminal receiving cavities 64. The terminal receiving cavities 64 extend through the socket 50 from the opening 52 toward an opposing end 66 of the socket 50. The terminal receiving cavities 64 are dimensioned to retain terminals 80 therein.

Figure 5:
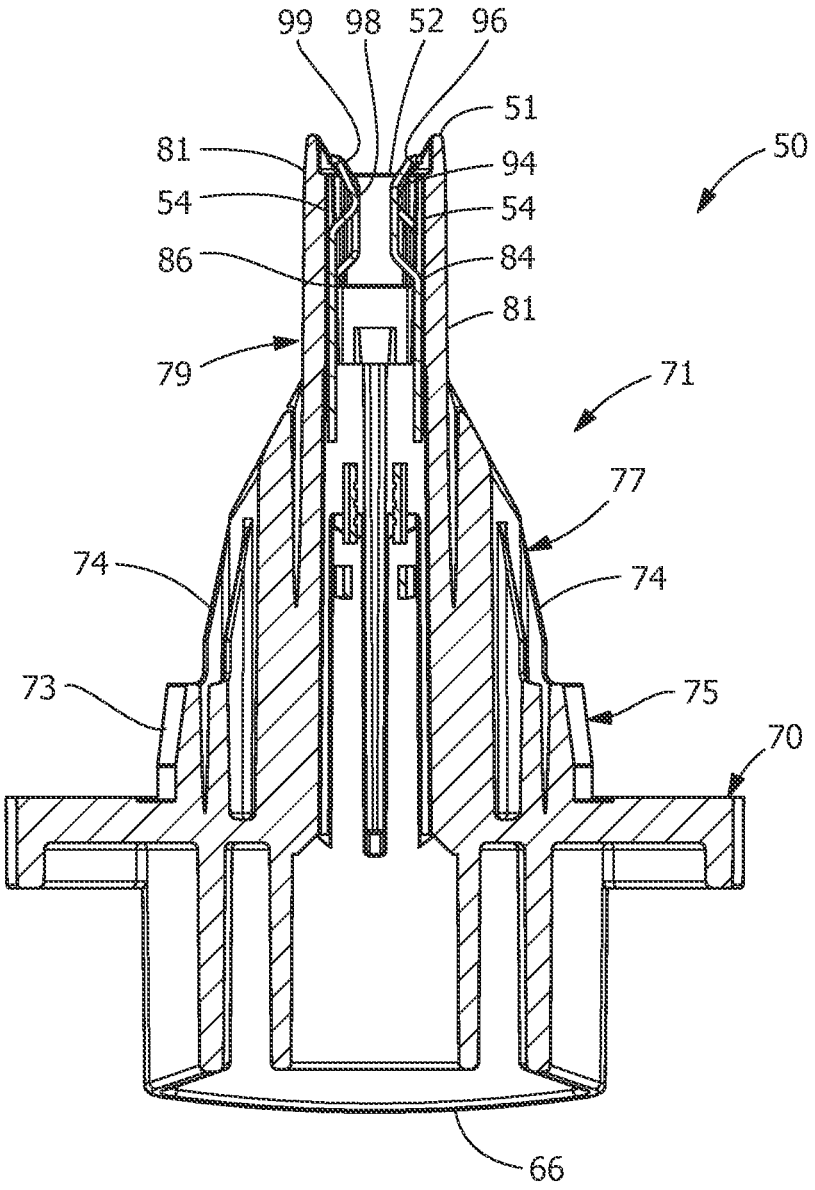
FIG. 5 is a cross-section view, taken along line 5-5 of FIG. 3, of the bulb socket.

Referring to FIGS. 1 and 5, the socket 50 has a mounting member 70 projecting therefrom. The mounting member 70 extends circumferentially around the socket 50 and cooperates with a mounting opening or the like (not shown) to maintain the socket 50 is proper position on a mating panel, substrate or other mating surface. Projections 72 are provided on the mounting member 70 to engage locking projections (not shown) of the mating panel to resiliently or frictionally maintain the socket 50 in position, thereby preventing unwanted movement or removal of the socket 50.

As best shown in FIGS. 1 and 5, the circumference of the exterior of a bulb receiving portion 71 of the socket 50 which extends from the mounting member 70 to the end 51 is reduced as measured from the mounting member 70 to the end 51, such that the profile of the socket 50, when viewed from the top, at the end 51 is approximately equal to the profile of the opening 52. In contrast, the profile of the socket 50, when viewed from the top, proximate the mounting member 70 is larger than the profile of the opening 52. This forms an essentially or hybrid conical structure. In the embodiment shown, the hybrid conical structure is not a perfect conical structure, as it has two arcuate sides and two essentially flat sides.

Figure 7:
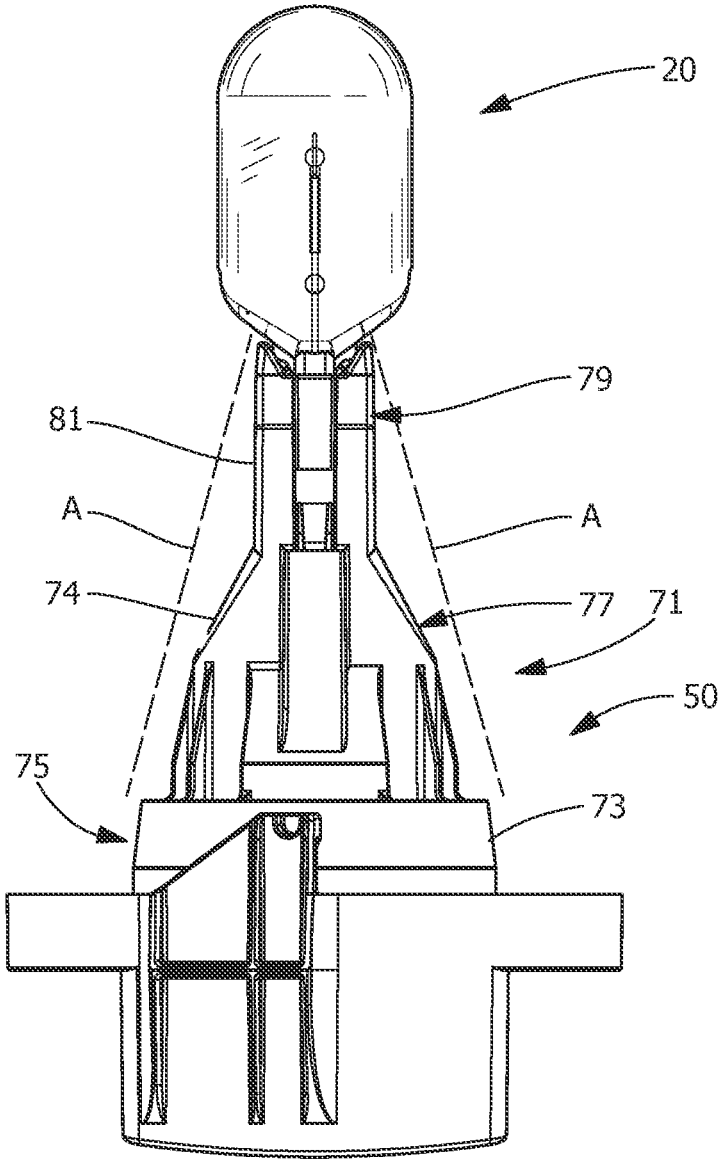
FIG. 7 is a side view of the bulb socket of FIG. 1 with a bulb inserted into a bulb receiving opening of the socket.

Referring to FIGS. 5 and 7, the bulb receiving portion 71 has a third portion 75 which is provided proximate the mounting member 70, a second portion 77 which extends from the third portion 75 in a direction away from the mounting member and toward the end 51, and a first portion 79 which extends from the second portion 77 to the end 51.

The third portion 75 has a generally cylindrical configuration. The outside surface 73 of the third portion 75 has a slight taper, such that the circumference of the third portion 75 proximate the mounting member 70 is larger than the circumference of the third portion 75 proximate the second portion 77.

Figure 4:
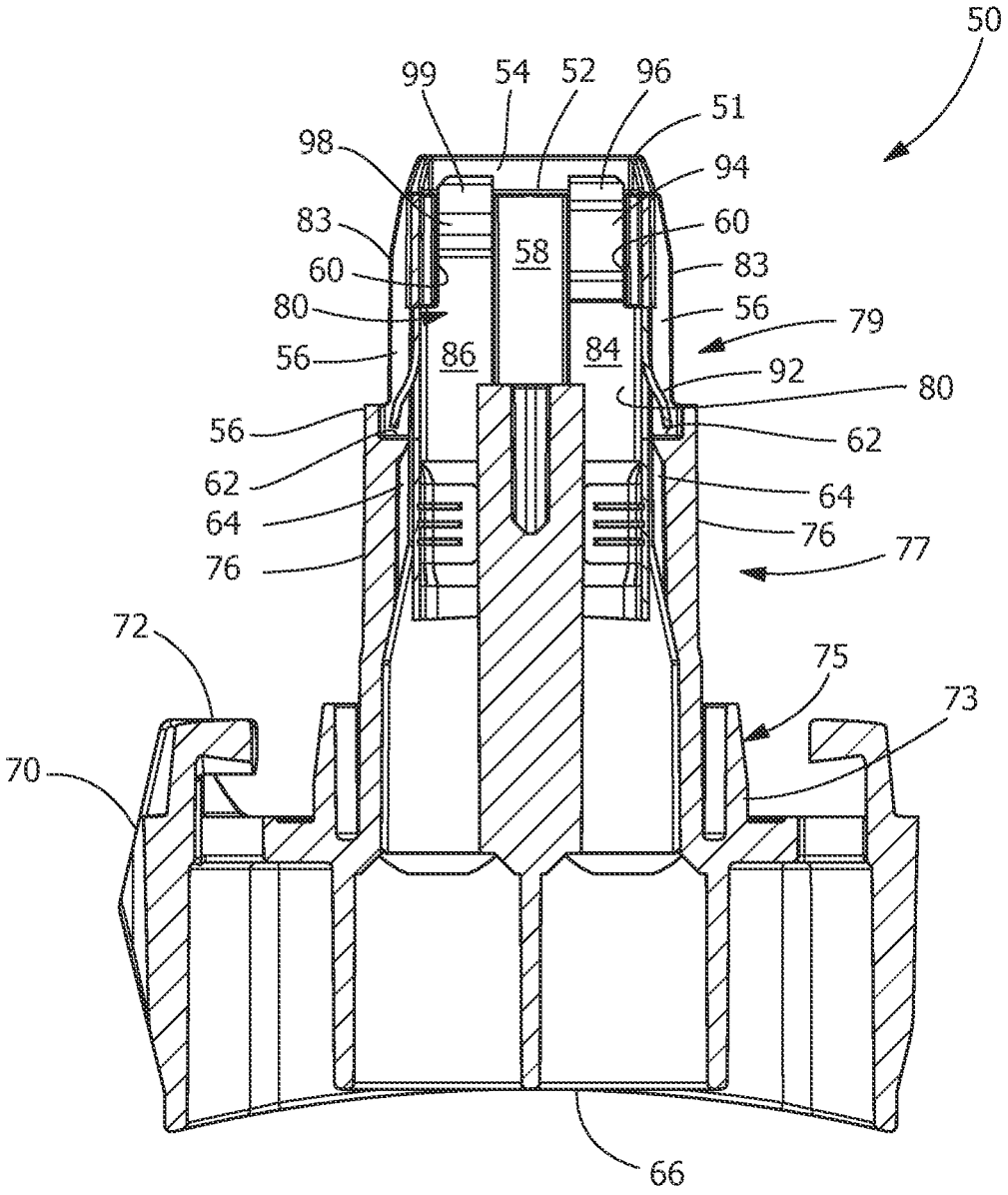
FIG. 4 is a cross-section view, taken along line 4-4 of FIG. 3, of the bulb socket.

The second portion 77 has a substantially conical configuration. First outside surfaces 74 of the second portion 77 are tapered inward, such that the perimeter of the second portion 77 proximate the third portion 75 is larger than the perimeter of the second portion 77 proximate the first portion 79. In the embodiment shown, second outside surfaces 76, which extend between the first outside surfaces 74, have a relatively flat configuration (FIG. 4). The ends 78 of first outside surfaces 74 which are proximate the first portion 79 have an arcuate configuration (FIG. 1).

The first portion 79 has a substantially rectangular configuration. The outside surfaces 81, 83 of the first portion 79 have a relatively flat configuration, such that the rectangular perimeter of the first portion 79 proximate the second portion 77 is substantially the same as the rectangular perimeter of the first portion 79 proximate the end 51. The portion of the surfaces 83 proximate the end 51 may have a slight inward taper, as shown in FIG. 4. The bulb receiving opening 52 is provided in the first portion 79.

Figure 6:
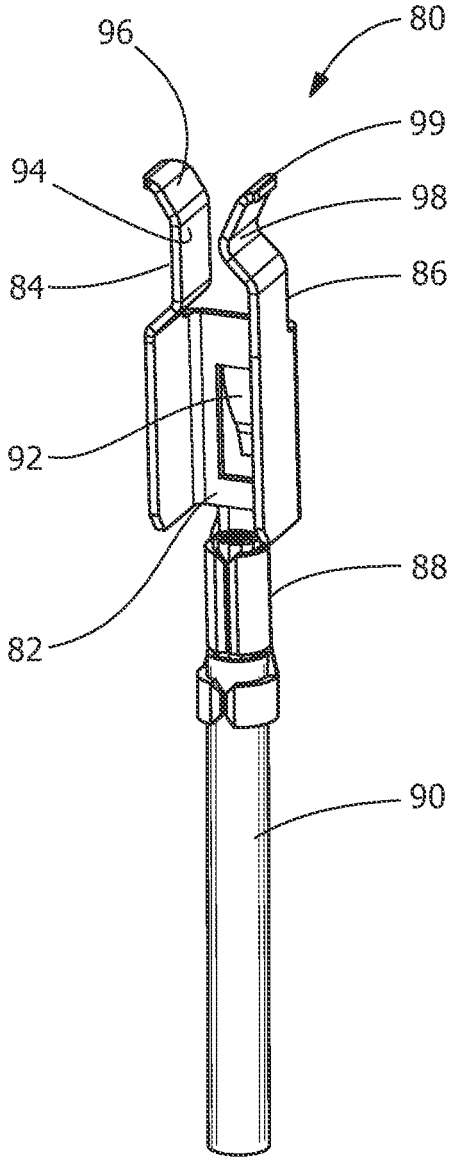
FIG. 6 is a perspective view of an illustrative contact which can be used with the bulb socket of FIG. 1.

As best shown in FIG. 6, terminals or contacts 80 are provided in the socket 50. Each terminal 80 has a mounting section 82 with two resilient contact or spring arms 84, 86 extending therefrom. A wire crimping section 88 extends from the mounting section 82 is a direction opposed to the direction of the arms 84, 86. A respective wire 90 is inserted into and crimped to the wire crimping section 88 in a known manner.

A resilient mounting arm or latch 92 extends from the mounting section 82. In the embodiment shown, the mounting latch 92 is cut and formed from the mounting section 82. The mounting latch 92 cooperates with the bottom wall 62 (FIG. 4) of the opening 52 to maintain the terminal 80 in position the terminal receiving cavities 64.

Contact or spring arms 84, 86 extend essentially perpendicular to the mounting section 82. As best shown in FIG. 6, a support portion 94 of arm 84 extends toward arm 86. The support portion 94 has a flat portion which cooperates with the base 28 of the bulb 20, as will be more fully described. A lead-in surface 96 extends from the support portion 94. A contact and securing portion 98 of arm 86 extends toward arm 84. The contact and securing portion 98 has a rounded or angular portion which cooperates with the portion 24*b* of lead 24 and the grooves 36 of the base 28 of the bulb 20, as will be more fully described. A lead-in surface 99 extends from the contact and securing portion 98.

Referring to FIGS. 1, 3 5 and 6, terminals 80 are provided in opening 52 such that the arm 84 of a respective first terminal 80 is positioned in a respective terminal receiving area 60 of internal long wall 54 of opening 52 and the arm 86 of the same first terminal 80 is positioned in a respective terminal receiving area of the opposed long wall 54. When viewed in FIGS. 1 and 3, the arms 84, 86 of the first terminals 80 are positioned to the left of the positioning member 58. The arm 84 of a respective second terminal 80 is positioned in a respective terminal receiving area 60 of internal long wall 54 of opening 52 and the arm 86 of the same second terminal 80 is positioned in a respective terminal receiving area of the opposed long wall 54. When viewed in FIGS. 1 and 3, the arms 84, 86 of the second terminals 80 are positioned to the right of the positioning member 58. The arm 84 of the first terminal and the arm 86 of the second terminal are positioned along the same long wall 54 on either side of the positioning member 58. Similarly, the arm 86 of the first terminal and the arm 84 of the second terminal are positioned along the same long wall 54 on either side of the positioning member 58.

As the bulb 20 is inserted into the opening 52 of the socket 50, the base 28 is guided into position between the arms 84, 86 by the lead-in surfaces 96, 99. The positioning member 42 of the base 28 also cooperates with the positioning member 58 of the opening 52 to properly position the base 28 of the bulb 20 in the opening 52 of the socket 50.

With the bulb 20 properly aligned in the opening 52, force is exerted on the bulb 20 to move the base 28 into the opening 52. As the base 28 is moved into the opening 52, the base 28 causes the resilient arms 84, 86 to be displaced toward walls 54. The positioning of the arms 84, 86 proximate the long walls 54 prevents the arms 84, 86 from being overstressed, thereby preventing the arms 84, 86 from taking a permanent set.

Insertion of the bulb 20 continues until the contact and securing portions 98 of the terminals 80 are received in the grooves 36 of the base 28. In this position, the arms 86 return toward an unstressed position, causing the contact and securing portions 98 to be received and maintained in the grooves 36. This provides a snap-in retention feature which provides a positive retention of the bulb 20 in the opening 52. During the insertion of the bulbs 20, the terminals 80 are prevented from moving downward due to the cooperation of the mounting arms 92 with the bottom wall 62.

In this fully inserted position, the contacting and securing portions 98 of arms 86 engage the portions 24*b* of the leads 24. As the arms 84 are resiliently deformed, the contacting and securing portions 98 exert a sufficient force on the portions 24*b* of the leads 24 to insure that a positive electrical connection is affected. The support sections 94 engage the base 28 to provide sufficient opposing force to maintain the base 28 in proper position. The arms 84, 86 are arranged in pairs along the two long walls 54 of the bulb insertion opening 52 in such a manner that they are substantially opposed to each other. Accordingly, the leads 24 can be held in pressure contact with the contact and securing portions 98 of the terminals 80 within the bulb insertion opening 52, thereby securing an electric connection between them. Additionally, the forces exerted on the base 28 cause the base 28 to be properly positioned and firmly retain in the socket 50.

Referring to FIG. 7, with the bulb 20 properly inserted into the socket 50, the configuration of the socket, and in particular, the configuration of the first portion 79 and the second portion 77, does not obstruct the performance of the bulb, allowing all or approximately all of the light capacity of the bulb to be utilized. Due to the configuration of the first portion 79 and the second portion 77 of the socket 50, the light from the bulb 20 is able to radiate in all directions without obstruction, including toward the mounting member 70, as indicated by the dotted lines A. In so doing, shadow projections are minimized or eliminated, thereby minimizing or eliminating undesirable dark spots.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A bulb socket for receiving a bulb therein, the bulb socket comprising:

a first portion having a bulb receiving opening;

a second portion extending from the first portion, the second portion having first outside surfaces which are tapered inward, the perimeter of the second portion proximate the first portion is less than the perimeter of the second portion spaced from the first portion;

terminals are provided in the bulb receiving opening, each terminal has a resilient mounting latch which extends from a mounting section, the mounting latch cooperates with a bottom wall of the bulb receiving opening to maintain the terminal in position in the bulb receiving opening;

whereby the second portion does not obstruct the performance of the bulb, allowing the light capacity of the bulb to be utilized.

2. The bulb socket as recited in claim 1, wherein the second portion has second outside surfaces, which extend between the first outside surfaces, the second outside surfaces have a flat configuration.

3. The bulb socket as recited in claim 1, wherein ends of the first outside surfaces which are proximate the first portion have an arcuate configuration.

4. The bulb socket as recited in claim 1, wherein a third portion is provided proximate the second portion, the third portion has a tapered cylindrical configuration whereby the perimeter of the third portion proximate the second portion is less than the perimeter of the third portion spaced from the second portion.

5. The bulb socket as recited in claim 1, wherein terminals are provided in the bulb receiving opening, each terminal has a first resilient arm and a second resilient arm, the first resilient arm has a support portion which extends toward the second resilient arm, the support portion has a flat portion which cooperates with a base of the bulb, the second resilient arm has a contact and securing portion which extends toward the first resilient arm, the contact and securing portion has an angular portion which cooperates with a lead of the bulb, whereby the contacting and securing portion exerts a sufficient force on the lead to insure that a positive electrical connection is affected, the support portion engages the base to provide sufficient opposing force to maintain the base in proper position.

6. The bulb socket as recited in claim 1, wherein the first portion has a rectangular configuration.

7. The bulb socket as recited in claim 6, wherein a perimeter of the first portion proximate second portion is the same as a perimeter of the first portion proximate an end of the bulb socket through which the bulb receiving opening extends.

8. The bulb socket as recited in claim 1, wherein the bulb receiving opening has a positioning member which extends between two terminal receiving areas.

9. The bulb socket as recited in claim 8, wherein the positioning member has an arcuate configuration, whereby the positioning member cooperates with a positioning member of the bulb to properly position the bulb in the bulb receiving opening.

10. The bulb socket as recited in claim 1, wherein terminals are provided in the bulb receiving opening, each terminal has resilient arms, a first resilient arm has a support portion which extends toward a second resilient arm, the second resilient arm has a contact and securing portion which extends toward the first resilient arm.

11. The bulb socket as recited in claim 10, wherein the support portion has a flat portion which cooperates with a base of the bulb.

12. The bulb socket as recited in claim 10, wherein the contact and securing portion has an angular portion which cooperates with a lead of the bulb.

13. A bulb socket for receiving a bulb therein, the bulb socket comprising:

a first portion having a bulb receiving opening, the first portion has a rectangular configuration, a perimeter of the first portion proximate a second portion is the same as a perimeter of the first portion proximate an end of the bulb socket through which the bulb receiving opening extends;

the second portion extending from the first portion, the second portion having first outside surfaces which are tapered inward, the perimeter of the second portion proximate the first portion is less than the perimeter of the second portion spaced from the first portion, the second portion has second outside surfaces which extend between the first outside surfaces, the second outside surfaces have a flat configuration;

whereby the second portion does not obstruct the performance of the bulb, allowing the light capacity of the bulb to be utilized.

14. The bulb socket as recited in claim 13, wherein ends of the first outside surfaces which are proximate the first portion have an arcuate configuration.

15. The bulb socket as recited in claim 13, wherein the bulb receiving opening has a positioning member which extends between two terminal receiving areas, the positioning member has an arcuate configuration, whereby the positioning member cooperates with a positioning member of the bulb to properly position the bulb in the bulb receiving opening.

16. The bulb socket as recited in claim 13, wherein terminals are provided in the bulb receiving opening, each terminal has a first resilient arm and a second resilient arm, the first resilient arm has a support portion which extends toward the second resilient arm, the support portion has a flat portion which cooperates with a base of the bulb, the second resilient arm has a contact and securing portion which extends toward the first resilient arm, the contact and securing portion has an angular portion which cooperates with a lead of the bulb, whereby the contacting and securing portion exerts a sufficient force on the lead to insure that a positive electrical connection is affected, the support section engages the base to provide sufficient opposing force to maintain the base in proper position.

17. The bulb socket as recited in claim 16, wherein each terminal has a resilient mounting latch which extends from a mounting section, the mounting latch cooperates with a bottom wall of the bulb receiving opening to maintain the terminal in position in the bulb receiving opening.

18. A bulb socket for receiving a bulb therein, the bulb socket comprising:

a first portion having a bulb receiving opening, the first portion has a rectangular configuration, a perimeter of the first portion proximate a second portion is the same as a perimeter of the first portion proximate an end of the bulb socket through which the bulb receiving opening extends;

the second portion extending from the first portion, the second portion having first outside surfaces which are tapered inward, the perimeter of the second portion proximate the first portion is less than the perimeter of the second portion spaced from the first portion, the second portion has second outside surfaces, which extend between the first outside surfaces, the second outside surfaces have a flat configuration;

terminals extending in the bulb receiving opening, each terminal has a first resilient arm and a second resilient arm, the first resilient arm has a support portion which has a flat portion which cooperates with a base of the bulb, the second resilient arm has a contact and securing portion which has an angular portion which cooperates with a lead of the bulb;

whereby the second portion does not obstruct the performance of the bulb, allowing the light capacity of the bulb to be utilized.

19. The bulb socket as recited in claim 18, wherein the bulb receiving opening has a positioning member which extends between two terminal receiving areas, the positioning member has an arcuate configuration, whereby the positioning member cooperates with a positioning member of the bulb to properly position the bulb in the bulb receiving opening.

* * * * *